US006092583A

United States Patent [19]

Furusawa

[11] Patent Number: 6,092,583

[45] Date of Patent: Jul. 25, 2000

[54] CLOSURE MEMBER AND CLOSING CONSTRUCTION

[75] Inventor: Hidetoshi Furusawa, Tokyo, Japan

[73] Assignees: Nisshin Steel Co., Ltd.; Nisshin A & C Co., Ltd., both of Tokyo, Japan

[21] Appl. No.: 09/230,287

[22] PCT Filed: May 26, 1998

[86] PCT No.: PCT/JP98/02289

§ 371 Date: Jan. 25, 1999

§ 102(e) Date: Jan. 25, 1999

[87] PCT Pub. No.: WO98/59142

PCT Pub. Date: Dec. 30, 1998

[30] Foreign Application Priority Data

Jun. 24, 1997 [JP] Japan ..... 9-183101

[51] Int. Cl.[7] ..... A47H 1/06

[52] U.S. Cl. ..... 160/330; 160/331; 160/352

[58] Field of Search ..... 160/330, 331, 160/348, 345, 85, 352, 341

[56] References Cited

U.S. PATENT DOCUMENTS 3,115,182 12/1963 Bobbitt ..... 160/348
5,372,173 12/1994 Horner ..... 160/98

FOREIGN PATENT DOCUMENTS 6-33663 2/1994 Japan .

*Primary Examiner*—Blair M. Johnson
*Attorney, Agent, or Firm*—Foley & Lardner

[57] ABSTRACT

A closure member comprises a flexible sheet curved wavily so as to wave in the horizontal direction, and a drive which causes the flexible sheet to wave forward. A closure structure comprises this closure member and is further provided with a wall member on each side of the flexible sheet in the hill-to-valley direction in its side view, which may further be provided with a moving floor beneath the flexible sheet.

3 Claims, 8 Drawing Sheets

CLOSURE MEMBER AND CLOSING CONSTRUCTION

TECHNICAL FIELD

This invention relates to a closure member and a closure structure which are used in place of doors, shutters and the like at entrances, and are constituted of a flexible sheet curved wavily so as to wave in the horizontal direction. The sheet is provided on this side of an entrance toward the inner part so that the entrance is closed by hill and valley of the sheet and, when one goes in or out, the sheet is caused to wave forward so that one can go in or out when an end of the sheet stands a hill or a valley and can move with the forward movement of the hill or valley.

BACKGROUND ART

In movie theaters and other theaters, lobbies are kept light during the performance, but seat rooms or auditorium rooms are made dim on the opening of a performance and kept dim until the end of the performance. However, doors that are opened or closed by the aid of hinge structure are used at the entrances through which spectators enter the seat room or auditorium room from the lobby. Hence, when a spectator opens and closes a door to go in or out, the light in the lobby streams into the seat room or auditorium room to give an unpleasant feeling to spectators who are appreciating the movie or play at the seats near to the door. Since, however, single-door closing members having such a structure that the light may not stream in when the door is opened or closed are not available, it has been difficult to change doors with hinge structure for those with different structure.

An object of the present invention is to provide a closure member that can prevent light from streaming in from the outside when the door is opened and closed.

Another object of the present invention is to provide a closure structure that can prevent light from streaming in from the outside when the door is opened and closed.

Still another object of the present invention is to provide a closure structure that can prevent light from streaming in from the outside when the door is opened and closed and also can carry those who go in or out when the door is opened and closed.

DISCLOSURE OF THE INVENTION

The first of the present invention is a closure member comprising a flexible sheet curved wavily so as to wave in the horizontal direction, and a drive which causes the flexible sheet to wave forward.

The second of the present invention is a closure structure comprising a flexible sheet curved wavily so as to wave in the horizontal direction, a drive which causes the flexible sheet to wave forward, and a wall member provided on each side of the flexible sheet in the hill-to-valley direction in its side view; the flexible sheet being in contact with each wall member.

The third of the present invention is a closure structure comprising a flexible sheet curved wavily so as to wave in the horizontal direction, a drive which causes the flexible sheet to wave forward, a wall member provided on each side of the flexible sheet in the hill-to-valley direction in its side view, and a moving floor provided beneath the flexible sheet along the forward-waving direction of the sheet; the flexible sheet being in contact with each wall member.

In the first of the present invention, the flexible sheet is curved wavily so as to wave in the horizontal direction.

Hence, the flexible sheet can close the space at its part extending from a hill to a valley as viewed from its one-side lateral surface. The hill and valley of this sheet always exist even when the flexible sheet is caused to wave forward from one end to the other end by means of the drive. Accordingly, a tunnel type enclosure made of an opaque material may be provided around the sheet which waves forward and the sheet may be caused to wave forward in such a state that the height (width) of the forward waving is identical to or larger than the width of the enclosure, thus the hill and valley move forward while coming in contact with the enclosure and can prevent the light from streaming in from the outside. To go in and out through the closure member, one may enter the area defined by the hill or valley when one end of the sheet forms the hill or valley of the waving on the external side. Since this hill or valley area which one has entered moves forward in the inner direction, one may walk in the inner direction synchronizingly with the forward-movement speed of the sheet while watching its forward-movement speed, and may go to the inside through the other end of the sheet.

In the second of the present invention, the wall member is provided on each side of the flexible sheet in the hill-to-valley direction in its side view and the flexible sheet is in contact with each wall member. Hence, opaque materials may be used in the flexible sheet and wall member and a ceiling may be provided, thus the light can be prevented from streaming in from the outside.

In the third of the present invention, the moving floor is provided beneath the flexible sheet along the forward-waving direction of the sheet. Hence, the speed of the moving floor may be kept adjusted to the forward-waving speed of the flexible sheet, thus it becomes unnecessary to walk while watching the forward-waving speed of the flexible sheet.

BEST MODE FOR WORKING THE INVENTION

Figure 1:
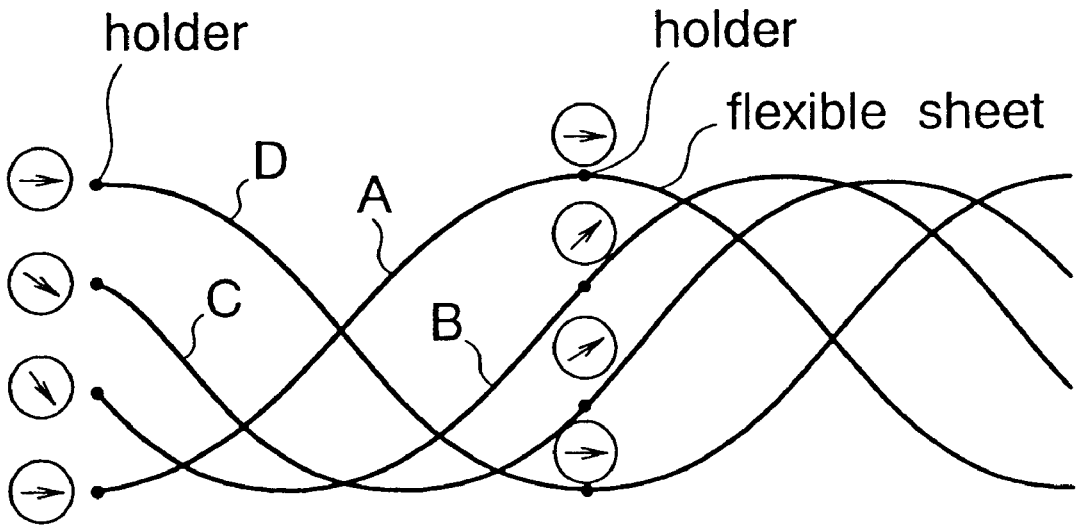
FIG. 1 shows the relationship between the reciprocal movement and the rotation, of a holder of the flexible sheet when the flexible sheet is caused to wave forward.

In the first to third of the present invention, in order to cause the flexible sheet to wave forward, a material having an impact resilience may be used in the flexible sheet so that the sheet can wave as shown in FIG. 1. More specifically, FIG. 1 shows how a flexible sheet which is set upright and curved wavily so as to wave in the horizontal direction stands as viewed from above the sheet, where the hill and valley of the flexible sheet move forward to the right in the order of wave A, wave B, wave C and wave D. Of arrows shown in circles, those on the left side indicate the direction that is tangent to the flexible sheet when the valley of wave A changes to the hill of wave D, and those at the middle indicate the direction that is tangent to the flexible sheet when the hill of wave A changes to the valley of wave D.

As viewed in this FIG. 1, when the flexible sheet kept in a state of wave A is caused to wave forward to the right to come into wave B, at the part of the left-end valley a holder may be fixed to the valley of the flexible sheet and first the holder may be rotated gradually clockwise while being moved upward so that the flexible sheet may become inclined downward to the right side from a horizontal state. Then, in order to further bring the wave B into wave C, now conversely the holder may be rotated gradually counter-clockwise so that the flexible sheet may become less inclined downward to the right side. Then, in order to bring the wave C into wave D where the hill is formed at the left end, the holder may be returned to the original horizontal state.

On the contrary, at the part of the hill at the middle, a holder may be fixed similarly to the part of a flat hill and, when wave A is brought into wave B, first the holder may be rotated gradually counterclockwise while being moved downward so that the flexible sheet may become inclined downward to the left side from a horizontal state. Thereafter, in order to bring the wave B into wave C, the holder may be rotated gradually clockwise so that the flexible sheet may become less inclined downward to the left side. Then, in order to bring the wave B finally into wave D where the valley is formed at the middle, the holder may be returned to the original horizontal state.

Now, the drive may be provided with i) holders fixed to the flexible sheet at a plurality of positions set separately and ii) a moving mechanism which reciprocates in the hill-to-valley direction of the flexible sheet in its side view and causes the holders successively to rotate in a given direction and reversely in the course of forward movement of the reciprocation and to rotate in the direction opposite to the direction given in the forward movement and reversely in the course of backward movement, and each holder may be so set that its end projects in substantially the vertical direction to connect it to the moving mechanism. Thus, the flexible sheet can be caused to wave forward. Here, the holders may preferably be fixed to the flexible sheet in such a way that the holders hang the flexible sheet, in order to prevent the moving mechanism from obstrcucting walkers.

The moving mechanism of the drive may comprise a U-section having a slit at its bottom, a cylindrical cam provided in parallel to the open side of the U-section, and a disk larger in diameter than the slit, which is inserted in the groove of the U-section in such a way that its one surface is in parallel to the bottom of the U-section and which is provided thereon with a slide runner having a length larger than the width of a screw channel of the cylindrical cam, in such a way that it projects to the open side of the U-section, and to the bottom of which the holder of the flexible sheet is fixed through the slit of the U-section. The U-section may be provided above the flexible sheet and with its open side up in such a state that it extends in the hill-to-valley direction of the flexible sheet in its side view, and the slide runner may be fitted to the screw channel of the cylindrical cam. Use of such a mechanism enables the slide runner to reciprocate inside the groove of the U-section according to the rotation of the cylindrical cam. Also, since the slide runner has a length larger than the wide of the screw channel of the cylindrical cam, its direction changes with the slant of the screw channel during the rotation of the cylindrical cam. However, since the disk can rotate inside the U-section, the holder moves in conformity with the direction of the slide runner. Hence, the holder of the flexible sheet is rotated successively in a given direction and reversely in the course of forward movement and is rotated in the direction opposite to the direction given in the forward movement and reversely in the course of backward movement.

EXAMPLES

In FIGS. 2 to 5, reference numeral 1 denotes a right horizontal bottom frame; 2, a left horizontal bottom frame; 3 and 4, pillars whose bases are fixed upright to the right horizontal bottom frame 1; 5 and 6, pillars whose bases are fixed upright to the left horizontal bottom frame 2; 7, a right horizontal top frame to which the ends of the pillars 3 and 4 are fixed; 8, a left horizontal top frame to which the ends of the pillars 5 and 6 are fixed; 9, a top front frame; and 10, a top back frame. Three rotating shafts 11, 12 and 13 are inserted across the right horizontal bottom frame 1 and the left horizontal bottom frame 2, and three sprockets 14, 15 and 16 are fixed to the rotating shaft 11, positioned in the rear, on its outer side of the right horizontal bottom frame 1. A rotating shaft 17 is also inserted to the right horizontal bottom frame 1 in the rear of the rotating shaft 11, and, on its inner side of the right horizontal bottom frame 1, is connected to a motor 18. On its outer side, a sprocket 19 is fixed. Then, a chain 20 is engaged with this sprocket 19 and the sprocket 14 of the rotating shaft 11. A sprocket 21 is also fixed to the rotating shaft 12 positioned in the front of the right horizontal bottom frame 1 on the outer side of the right horizontal bottom frame 1, and a chain 20 is engaged with it and the sprocket 15 of the rotating shaft 11.

A rotating shaft 22 is also inserted to the right horizontal bottom frame 1 in the front of the rotating shaft 11, and a sprocket 23 is fixed thereto on the outer side of the right horizontal bottom frame 1. A chain 20 is engaged with this sprocket 23 and the sprocket 16 of the rotating shaft 11, and a chain 20 is also engaged, at its upper side, with a sprocket 24 fixed to the rotating shaft 13 on the outer side of the right horizontal bottom frame 1. One additional sprocket 25 is also fixed to the rotating shaft 13 on its outer side. Meanwhile, rollers 26 and 27 are fixed to the rotating shafts 11 and 12, respectively, on their portions between the right horizontal bottom frame 1 and the left horizontal bottom frame 2, and a conveyor 28 is stretched across the both rollers 26 and 27.

Three rotating shafts 29, 30 and 31 are inserted across the right horizontal top frame 7 and the left horizontal top frame 8, and two sprockets 32 and 33 are fixed to the rotating shaft 29, positioned in the rear, on its outer side of the right horizontal top frame 7. Then, a chain 20 is engaged with one of these, the sprocket 32, and the sprocket 25 of the rotating shaft 13 inserted to the right horizontal bottom frame 1. Rotating shafts 30 and 31 are positioned at the middle and front, respectively, of the right horizontal top frame 7 and left horizontal top frame 8. To these rotating shafts, sprockets 34 and 35 are fixed on their outer side of the right horizontal top frame 7. Then, a chain 20 is engaged with these sprockets 34 and 35 and the sprocket 33 of the rotating shaft 29 so that the rotating shafts 29, 30 and 31 can be rotated in the same direction.

Figure 6:
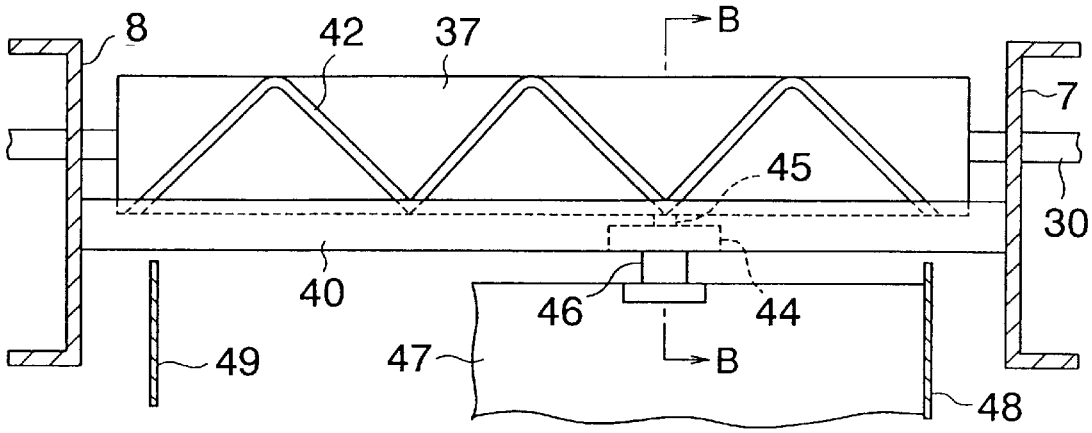
FIG. 6 is an enlarged view of a cross section along the line A—A in FIG. 2.
Figure 7:
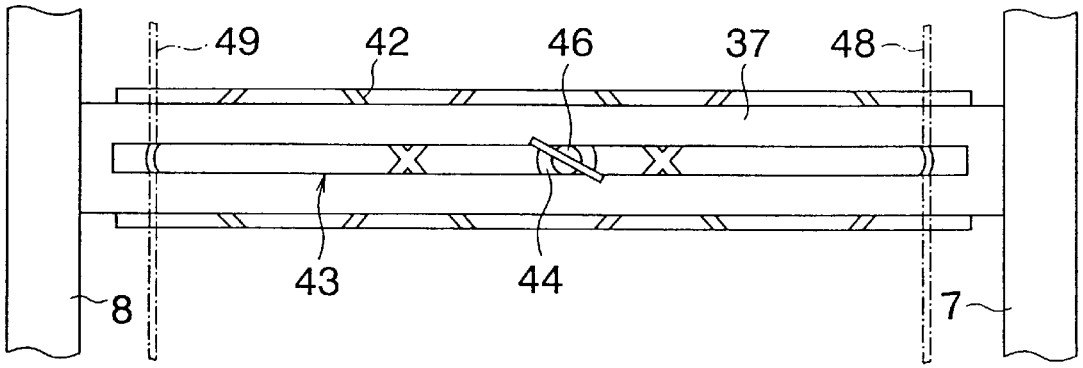
FIG. 7 is a bottom view of what is shown in FIG. 6.
Figure 8:
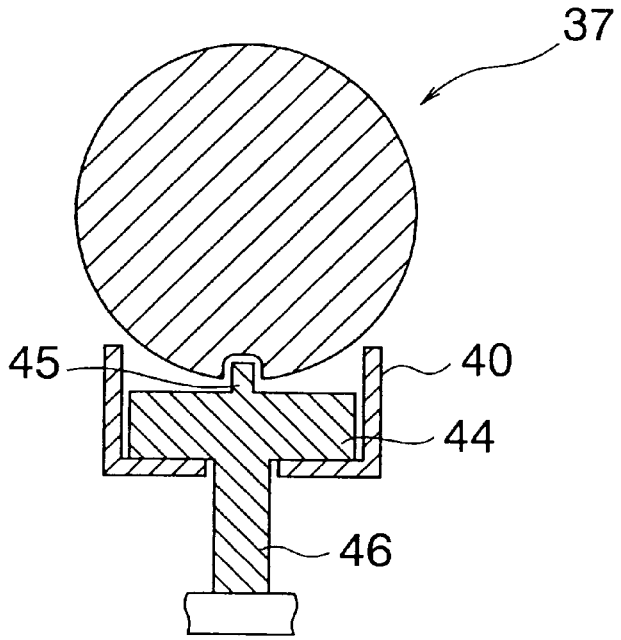
FIG. 8 is an enlarged view of a cross section along the line B—B in FIG. 6.
Figure 10:
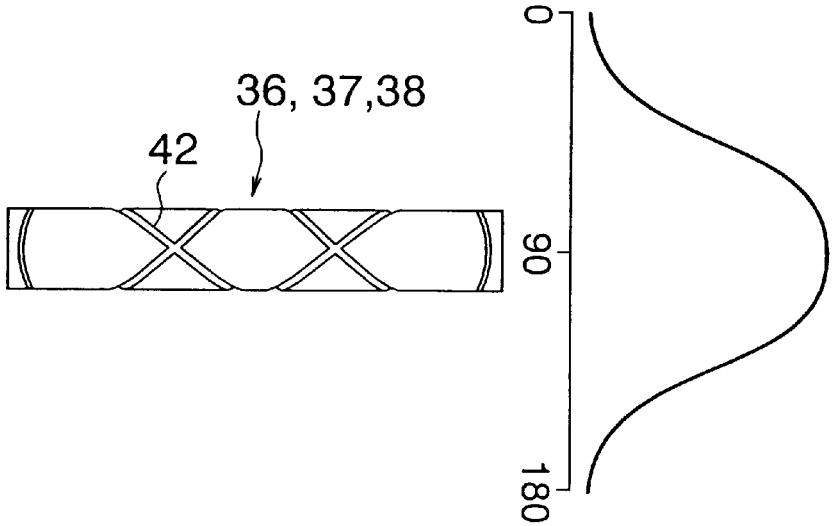
FIG. 10 shows the relationship between screw channels of the cylindrical cam and their development.

Meanwhile, cylindrical cams 36, 37 and 38 are fixed to the rotating shafts 29, 30 and 31, respectively, on their portions between the right horizontal top frame 7 and the left horizontal top frame 8. On their lower sides, U-sections 39, 40 and 41 opening upward are disposed in parallel. FIGS. 6 to 8 show how these are provided, in respect of an instance of the cylindrical cam 37 and U-section 40. The same also applies to instances of the cylindrical cam 36 and U-section 39, and the cylindrical cam 38 and U-section 41. All the cylindrical cams 36, 37 and 38 have like patterns in respect of screw channels 42 provided on their peripheries. The screw channels 42 each have a pattern as shown in FIG. 10, where a curve of 0 degree to 90 degrees as a sine curve is wound clockwise three times from one end toward the other end, thereafter a curve of 90 degrees to 180 degrees is wound counterclockwise three times from the other end toward one end, and the part of 0 degree and the part of 180 degrees are connected to make the curves continuous.

Figure 9:
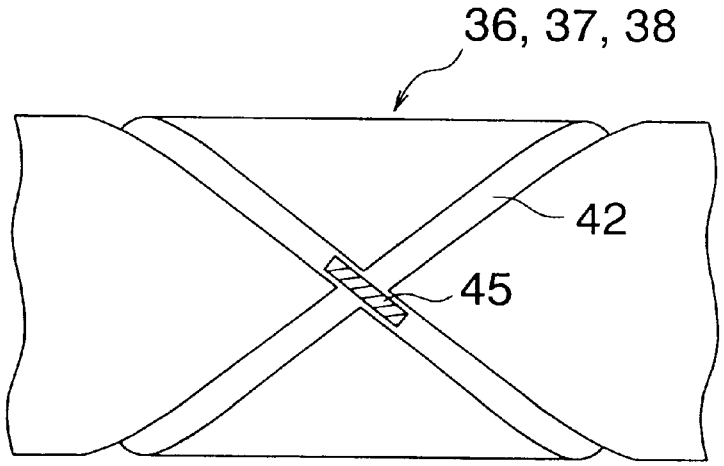
FIG. 9 illustrates how a slide runner moves slidably in screw channels of a cylindrical cam.
Figure 11:
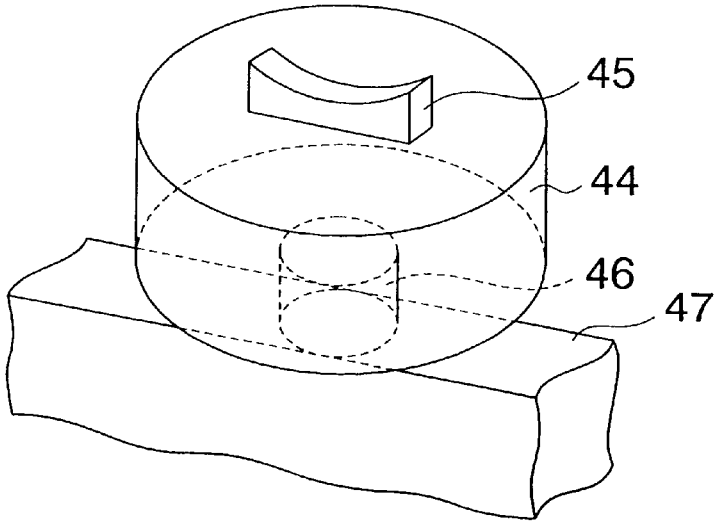
FIG. 11 is a perspective view of a disk inserted to a U-section.

All the U-sections 39, 40 and 41 also have like structures. They are all fixed at their both ends to the right horizontal top frame 7 and left horizontal top frame 8, and are provided in their bottoms with slits 43 extending in the axial directions of the cylindrical cams 36, 37 and 38. Then, to the inside of each U-section, a disk 44 having substantially such a size that its outer edge comes into touch with the side walls of the U-section 40 is inserted as shown in FIG. 8, and its undersurface comes into touch with the bottom of the U-section 40. On the top of this disk 44, a slide runner 45 is provided projectingly, and is fitted to the screw channel 42 of the cylindrical cam 37. To the undersurface, a holder 46 is fixed, and is projected downward through the slit 43. As shown in FIG. 11, the slide runner 45 has a length larger than the width of the screw channel 42, and is concaved in arc so that it can come into close contact with the cylindrical cam 36, 37 or 38. Thus, when guided through the screw channel 42, the slide runner 45 runs straight as shown in FIG. 9, even when it reaches the part where the screw channel 42 crosses, and does not rotate inside the screw channel 42. If the slide runner 42 has a length smaller than the width of the screw channel 42, the slide runner 45 may turn at the crossing of the screw channel 42 or may rotate as it can do, making it impossible to control the movement direction and rotation of the holder 46.

Figure 3:
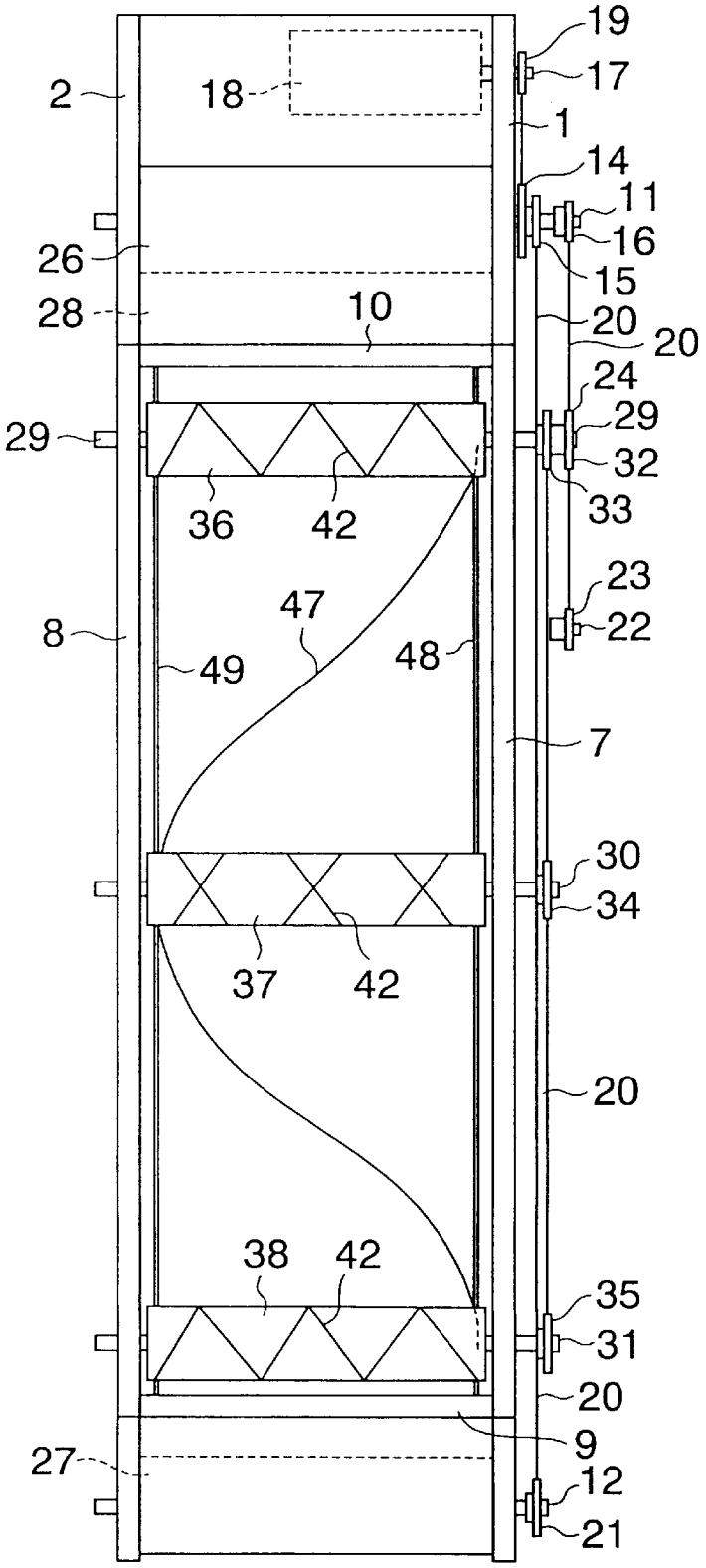
FIG. 3 is a plan view of what is shown in FIG. 2.
Figure 4:
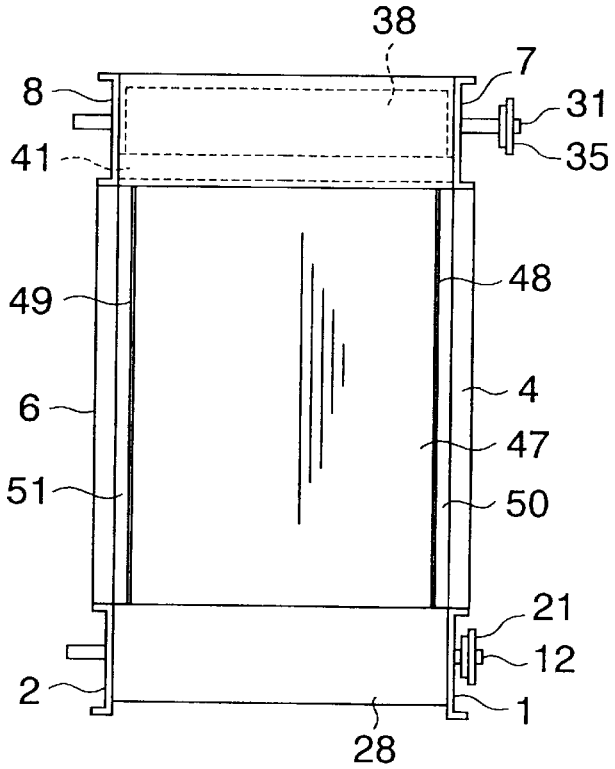
FIG. 4 is a left-side view of what is shown in FIG. 2.
Figure 5:
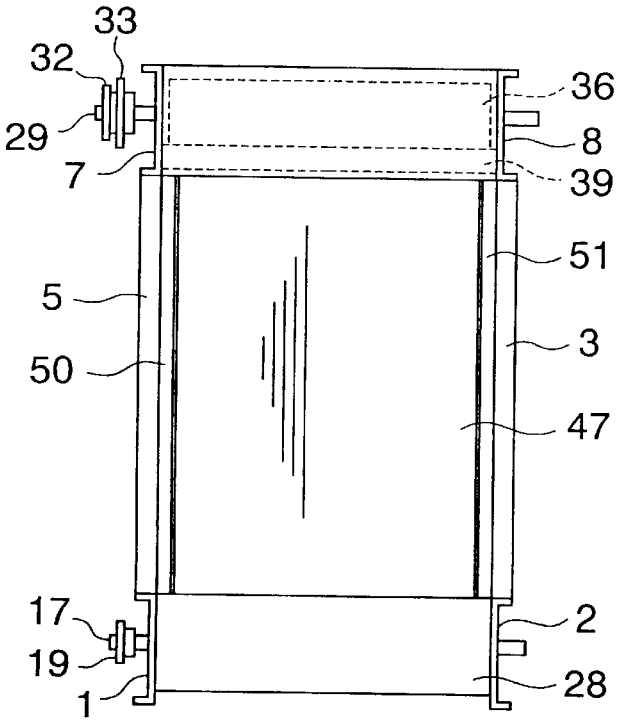
FIG. 5 is a right-side view of what is shown in FIG. 2.

To the lower parts of the holders 46, a single elongated sheet of the flexible sheet 47 is fixed at its upper long edge, which extends generally horizontally in a longitudinal direction of the closure member, and is hung up in such a way that its lower long edge, which also extends generally horizontally in a longitudinal direction of the closure member, may stand close to the conveyor 28. This flexible sheet 47 has a wavy form curved in the horizontal transverse direction as shown in FIG. 3. Its front end (i.e., the left end in FIG. 2) or its one short edge, which extends generally vertically, is positioned beneath the U-section 41; its middle or its middle in the long-side direction, beneath the U-section 40; and its rear end (i.e., the right end in FIG. 2) or the other short side, which also extends generally vertically, beneath the U-section 39. The front and rear ends where valleys are formed come into contact with a right wall member 48, and the middle where a hill is formed comes into contact with a left wall member 49. Here, the flexible sheet 47 may include sheets of plastic, rubber, fiber, nonwoven fabric or the like, and sheets obtained by connecting slats, boards, rod members or the like in the form of roller screens. The right wall member 48 is, as shown in FIG. 4, fixed to the inner sides of the right-side pillars 3 and 4 via a spacer 50, and the left wall member 49 is also fixed to the inner sides of the left-side pillars 5 and 6 via a spacer 51.

Figure 2:
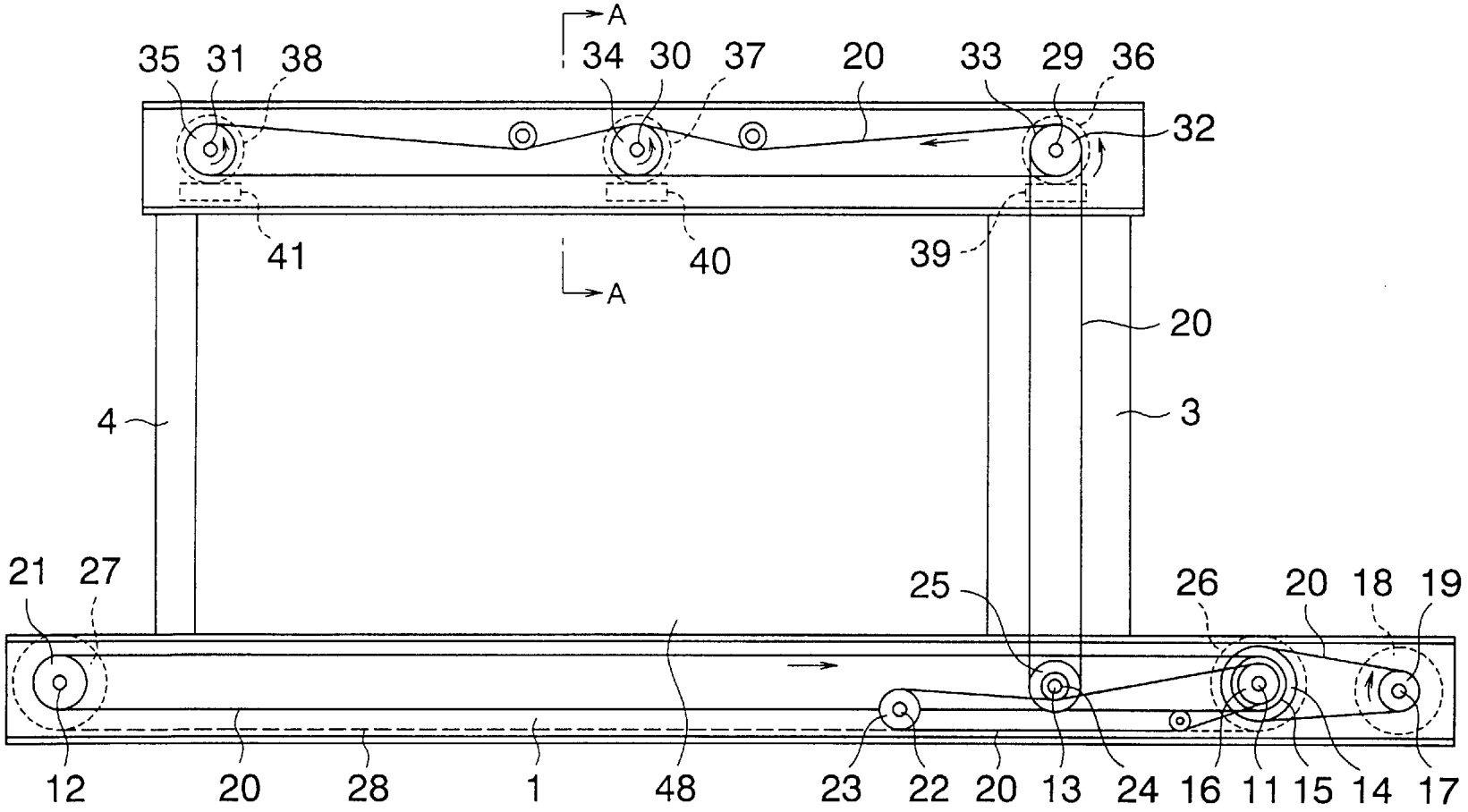
FIG. 2 is a side view of an example of the closure structure.

Under the construction as described above, the motor 18 is driven clockwise as viewed in FIG. 2, so that the conveyor 28 is rotated clockwise, and one who gets on the conveyor 28 from the left side is carried toward the right side. On the other hand, the cylindrical cams 36, 37 and 38 are all rotated counterclockwise, where the disks 44 provided with the slide runners 45 reciprocate through the insides of the U-sections 39, 40 and 41 by the action of the screw channels 42. Here, the reciprocal movement of the disks 44 and the rotation of the holders 46 has the following relationship.

To make it easy to understand the description, assume that, as shown in FIG. 3, the front and rear ends (both short edges) of the flexible sheet 47 are in contact with the right wall member 48 and the middle thereof in its long-side direction is in contact with the left wall member 49 and that the shape immediately before the start of forward waving corresponds to the wave A in FIG. 1. Assume also that, when the flexible sheet 47 stands in such a shape, i) with the screw channels 42 of the cylindrical cams 36 and 38 the slide runners 45 engage in such a way that the slide runners 45 slide through the counterclockwise spiral screw channels 42 and ii) the lengthwise direction of the slide runners 45 (positioned at right ends of the cams) and the direction of the flexible sheet 47 (at the front and rear ends) correspond to the back-and-forth direction, thus both the directions are in agreement. Assume still also that i) with the screw channel 42 of the cylindrical cam 37 the slide runner 45 engages in such a way that the slide runner 45 slides through the clockwise spiral screw channel 42 and ii) the lengthwise direction of the slide runner 45 (positioned at left end of the cam) and the direction of the flexible sheet 47 (at the middle) also correspond to the back-and-forth direction, thus both the directions are in agreement.

Figure 12:
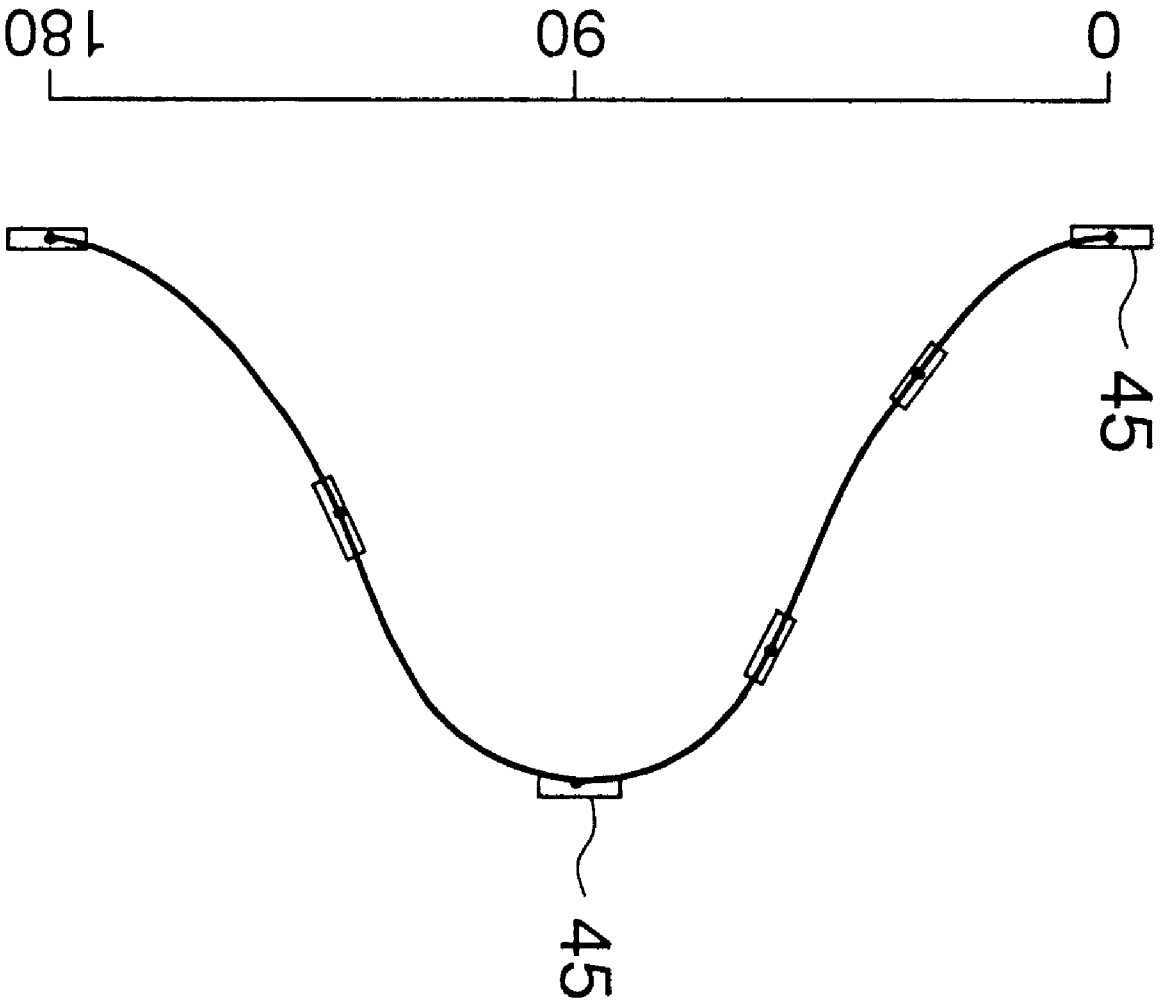
FIG. 12 shows how the slide runner is rotated which moves slidably in screw channels of a cylindrical cam.

In this state, the cylindrical cams 36 37 and 38 are rotated counterclockwise, so that the slide runners 45 in the cylindrical cams 36 and 38 move in the same manner as they slide in the direction from the 180-degree side toward the 90-degree side of a sine curve as shown in FIG. 12. During this sliding, since each slide runner 45 has a length larger than the width of the screw channel 42, the slide runner is rotated while following up the slant of the screw channel 42. Hence, once the slide runners 45 start to move to the left wall member 49, they start to rotate clockwise and the holders 46 cause the flexible sheet 47 standing in the back-and-forth direction (at the front and rear ends), to incline to the right side (viewed in FIG. 3). Then, the slide runners 45 approaches the middles of the cylindrical cams 36 and 38, whereupon they start to rotate counterclockwise, and continue this counterclockwise rotation until the slide runners 45 reach the ends of the screw channels 42 on the side of the left wall member 49. Hence, the flexible sheet 47 caused to incline to the right side (at the front and rear ends) immediately after the start of movement is caused to incline to the left side, and comes to stand in the back-and-forth direction when the slide runners 45 reach the ends of the screw channels 42 on the side of the left wall member 49. Incidentally, when the flexible sheet 47 is caused to wave forward (i.e. travel in the longitudinal direction), its both ends and middle move linearly in the waving direction.

The slide runner 45 in the cylindrical cam 37 also has a length larger than the width of the screw channel 42, and hence the slide runner is rotated while following up the slant of the screw channel 42. In the case of this slide runner 45 in the cylindrical cam 37, the cylindrical cam 37 rotates counterclockwise, where it moves in the same manner as it slides in the direction from the 90-degree side toward the 0-degree side of a sine curve as shown in FIG. 12. Hence, the rotation of the flexible sheet 47 by the slide runner 45 is opposite to the case of the slide runners 45 in the cylindrical cams 36 and 38. More specifically, once the slide runners 45 start to move to the right wall member 48, it starts to rotate counterclockwise and the holder 46 causes the flexible sheet 47 standing in the back-and-forth direction (at the middle), to incline to the left side. Then, the slide runners 45 approaches the middle of the cylindrical cam 37, whereupon it starts to rotate clockwise, and continue this clockwise rotation until the slide runner 45 reaches the end of the screw channel 42 on the side of the right wall member 48. Hence, the flexible sheet 47 caused to incline to the left side (at the middle) immediately after the start of movement is caused to incline to the right side, and comes to stand in the back-and-forth direction when the slide runner 45 reaches the end of the screw channel 42 on the side of the right wall member 48. The movement of the slide runner 45 in this cylindrical cam 37 toward the right wall member 48 side occurs in parallel to the movement of the slide runners 45 in the cylindrical cams 36 and 38 toward the left wall member 49 side, and hence the flexible sheet 47 comes to have the wave B and wave C shown in FIG. 1 to cause the forward waving.

One may get on the conveyor 28 when the front end of the flexible sheet 47 stands close to the right wall member 48 or left wall member 49 and the entrance-side middle area on the conveyor 28 is not occupied with the flexible sheet 47. In the present example, the speed of the conveyor 28 and the speed of forward waving of the flexible sheet 47 are adjusted according to the ratio of sprockets. Thus, the part where one is getting on always forms the hill or valley of the waving, and one can be free from contact with the flexible sheet 47 until one gets off the conveyor 28.

POSSIBILITY OF INDUSTRIAL APPLICATION

As described above, in the closure member and closure structure of the present invention, the flexible sheet curved wavily is caused to wave forward to open and close the passage, and hence the light can be prevented from streaming in from the outside so long as the flexible sheet is made of an opaque material. Also, the flexible sheet always keeps the inside shut up from the outside, and hence the present closure member or closure structure may be used at entrances of clean rooms, cold storage rooms, art galleries, museums and hospitals which are affected easily by the open air and dust that come in, whereby the inside can be kept shut up from the outside.

What is claimed is:

1. A closure member comprising:

an elongated flexible sheet, wherein short edges of the flexible sheet extend generally vertically, long edges of the flexible sheet extend generally horizontally in a longitudinal direction of the closure member, and the flexible sheet is curved to form waves in a horizontal transverse direction; and a drive that causes the transverse waves to travel in the longitudinal direction, wherein the drive is provided with i) holders having vertically projecting ends fixed to the flexible sheet at a plurality of positions set separately, and ii) a moving mechanism which causes the holders to reciprocate in the transverse direction such that when each holder translates in a first transverse direction, the holder rotates first in a counterclockwise direction and then in a clockwise direction, and when the holder translates in a second transverse direction, the holder rotates first in a clockwise direction and then in a counterclockwise direction.

2. The closure member according to claim 1, wherein said moving mechanism comprises i) a U-section having a slit at its bottom, ii) a cylindrical cam provided in parallel to the open side of the U-section, and iii) a disk larger in diameter than the slit, which is inserted in the groove of the U-section in such a way that one surface of the disk is in parallel to the bottom of the U-section and which is provided thereon with a slide runner having a length larger than the width of a screw channel of the cylindrical cam, in such a way that it projects to the open side of the U-section, and to the bottom of which the holders of the flexible sheet are fixed through the slit of the U-section; said U-section being provided above the flexible sheet and with its open side up in such a state that it extends in the transverse direction of the flexible sheet, and said slide runner being fitted to the screw channel of the cylindrical cam.

3. A closure structure comprising:

an elongated flexible sheet, wherein short edges of the flexible sheet extend generally vertically, long edges of the flexible sheet extend generally horizontally in a longitudinal direction of the closure member, and the flexible sheet is curved to form waves in a horizontal transverse direction;

a drive that causes the transverse waves to travel in the longitudinal direction from a first short edge to a second short edge;

a wall member provided on each side of the flexible sheet in the transverse direction, said flexible sheet being in contact with each wall member; and a moving floor provided beneath the flexible sheet and positioned along the longitudinal direction of the sheet.

* * * * *